United States Patent [19]

Szymaszek

[11] 4,419,865

[45] Dec. 13, 1983

[54] OIL COOLING APPARATUS FOR REFRIGERATION SCREW COMPRESSOR

[75] Inventor: Paul G. Szymaszek, Milwaukee, Wis.

[73] Assignee: Vilter Manufacturing Company, Milwaukee, Wis.

[21] Appl. No.: 336,501

[22] Filed: Dec. 31, 1981

[51] Int. Cl.[3] ..... F25B 31/00; F25B 43/02

[52] U.S. Cl. ..... 62/193; 62/470; 62/DIG. 2

[58] Field of Search ..... 62/192, 193, 194, 468, 62/469, 470, 473, 84, DIG. 2; 417/405, 406, 407

[56] References Cited

U.S. PATENT DOCUMENTS

| | | | |
|---|---|---|---|
| 2,986,898 | 6/1961 | Wood, Jr. | 62/174 |
| 3,067,590 | 12/1962 | Wood, Jr. | 62/DIG. 2 |
| 3,200,603 | 8/1965 | Wake et al. | 62/193 X |
| 3,408,828 | 11/1968 | Soumerai et al. | 62/470 |
| 4,275,570 | 6/1981 | Szymaszek et al. | 62/468 |

FOREIGN PATENT DOCUMENTS

| | | | |
|---|---|---|---|
| 644084 | 7/1962 | Canada | 417/405 |

*Primary Examiner*—Albert J. Makay
*Assistant Examiner*—Harry Tanner
*Attorney, Agent, or Firm*—James E. Nilles

[57] ABSTRACT

The invention relates to improvements in a refrigeration system having an oil cooled screw compressor from which mixed oil and compressed refrigerant issues to an oil separator via a discharge duct, and wherein a refrigerant pump draws liquid refrigerant from the high pressure receiver and delivers it to the discharge duct to cool the oil and desuperheat the refrigerant. The refrigerant pump and a hydraulic motor that drives it are in a single sealed housing. The hydraulic motor is energized with pressure oil from the oil pump whereby oil is returned to the compressor from the oil separator. Oil flow to the hydraulic motor is throttled in accordance with output from a temperature sensor at the discharge duct, to maintain a constant temperature of oil-refrigerant mixture passing to the oil separator. A standpipe arrangement prevents cavitation at the refrigerant pump.

4 Claims, 3 Drawing Figures

OIL COOLING APPARATUS FOR REFRIGERATION SCREW COMPRESSOR

FIELD OF THE INVENTION

This invention relates to refrigeration systems wherein refrigerant is compressed by a screw compressor that is lubricated and cooled by the circulation of oil therethrough; and the invention is more particularly concerned with improvements in refrigeration apparatus such as is disclosed in U.S. Pat. No. 4,275,570 to Szymaszek et al, issued June 30, 1981, wherein compressor oil is cooled by pumping a small amount of liquid refrigerant from the high pressure receiver of the system into a discharge duct that communicates the compressor discharge outlet with an oil separator.

BACKGROUND OF THE INVENTION

The refrigeration apparatus to which this invention relates comprises a screw compressor that is both cooled and lubricated by the circulation of oil therethrough. The oil issues from the compressor in a mixture with compressed refrigerant, and that mixture is delivered to an oil separator, from which the separated oil is returned to the compressor through an oil pump. The compressed refrigerant passes from the oil separator through a condenser to a high pressure receiver in which it is held for circulation through the evaporator or cooling coils of the system.

The above mentioned U.S. Pat. No. 4,275,570, which has a common assignee with the present application, discloses improved means for cooling the compressor lubricating oil, whereby the need for a separate oil cooling heat exchanger is eliminated. According to that patent, a small pump for liquid refrigerant is provided that has its inlet connected with the receiver and has its outlet communicated with the discharge duct that carries mixed oil and refrigerant from the compressor to the oil separator. The mixture of oil and compressed refrigerant is cooled by the liquid refrigerant which this pump introduces into the discharge duct; hence the refrigerant pump and its associated connection not only effect the necessary cooling of the lubricating oil but also greatly improve the performance of the oil separator and desuperheat the compressed refrigerant.

An important feature of the apparatus of U.S. Pat. No. 4,275,570 is provision for controlling the rate of delivery of liquid refrigerant from the high pressure receiver to the discharge duct, so as to match that rate to the prevailing output of the screw compressor. Such control ensures delivery of enough liquid refrigerant to afford adequate oil cooling but not so much as to cool the refrigerant to its saturation temperature and thus cause formation of drops of liquid refrigerant that would be separated out in the oil separator and would subsequently cause cavitation at the oil pump that returns the separated oil to the screw compressor. The preferred control system disclosed in the patent comprises a temperature sensor in the discharge duct, just ahead of the oil cooler, and a throttling valve controlled by the sensor and located between the refrigerant pump and the compressor discharge duct. With a positive displacement refrigerant pump driven by a constant speed motor, a pressure relief valve is connected in a return circuit between the outlet and the inlet of the refrigerant pump, to circulate back to its inlet such of its output as is not passed by the throttling valve.

The inclusion of this relief valve added to the cost and complexity of the apparatus, but the relief valve arrangement was nevertheless considered preferable to other obvious expedients for controlling the rate of delivery of liquid refrigerant to the compressor discharge duct. In particular, the use of a variable speed electric motor and means for controlling its speed in response to temperature in the discharge duct would have been more expensive and complicated than provision of the relief valve.

The patent points out that the system poses a problem with respect to adequate seals in the refrigerant pump, inasmuch as the liquid refrigerant bypassed from the high pressure receiver to the discharge duct is maintained under substantially high pressure as it passes through the pump. The refrigerant pump is therefore said to require expensive high pressure seals, but the patent characterizes the relatively high cost of such a pump as "insignificant in relation to the economic benefits achieved with the oil cooling means of the present invention." Thus the need for high pressure seals—although tolerable in view of off-setting gains—was recognized as a real disadvantage and one that had to be accepted because there was no obvious expedient for avoiding it.

Nevertheless, difficulties were encountered in providing completely effective high pressure seals for the refrigerant pump, and leakage through the seals, although not frequent, could occur and had potentially serious consequences when it did occur. Consideration was given to enclosing both the pump and its electric drive motor in a hermetically sealed housing, with no refrigerant seal between the pump and the motor, but this proposal was rejected because it solved one problem at the risk of creating another and more serious one. If the pump drive motor burned out, acids from its overheated insulation would contaminate the entire refigeration system.

Another problem sometimes encountered with the operation of the apparatus of U.S. Pat. No. 4,270,570 was cavitation of its refrigerant pump. The duct communicating the refrigerant pump inlet with the high pressure receiver is of relatively small diameter, because only a small rate of flow of refrigerant has to be produced by that pump. Liquid refrigerant in the receiver is near its vaporizing pressure, and pressure drop along the narrow duct leading to the refrigerant pump sometimes caused bubbles of vaporized refrigerant to form in that duct and cause cavitation at the pump.

SUMMARY OF THE INVENTION

The general object of the present invention is to provide a refrigerant system having a screw compressor and having a refrigerant pump that forces refrigerant from the high pressure receiver into a duct communicating the compressor discharge outlet with an oil separator, wherein the refrigerant pump which forces refrigerant from the receiver into the duct just mentioned does not need high pressure seals, can be simple and inexpensive, and can operate at controllably variable speed in accordance with the prevailing output of the screw compressor, to avoid the need for a relief valve and bypass.

Another object of this invention is to provide a refrigeration system of the character described that has a simple, reliable and inexpensive variable speed driving motor for its refrigerant pump and wherein the refrigerant pump and its driving motor are sealed into a common housing so that there can be no leakage of refrigerant from the pump.

A further object of the invention is to provide a refrigeration system of the general type disclosed in U.S. Pat. No. 4,275,570, wherein the motor that drives the refrigerant pump is simple and inexpensive but is nevertheless easily controlled as to its speed so that the rate at which refrigerant is pumped can be matched to the prevailing output of the screw compressor.

An additional and more specific object of the invention is to provide simple means in a refrigeration system of the character described for preventing cavitation of the refrigerant pump that draws refrigerant from the high pressure receiver and delivers it into the duct that communicates the compressor with the oil separator.

In general, these and other objects of the invention that will appear as the description proceeds are achieved in a refrigeration system comprising a screw compressor which is cooled and lubricated by the circulation of oil therethrough and from which a mixture of compressed refrigerant and oil issues to an oil separator through a discharge duct. The system further comprises an oil pump for circulating oil back to the screw compressor from the oil separator, a receiver to which refrigerant flows from the oil separator through a condenser and in which liquid refrigerant is held for circulation through an evaporator, and delivery means comprising a refrigerant pump having a refrigerant inlet connected with the receiver and an outlet communicated with said discharge duct to deliver thereto a flow of liquid refrigerant that cools said mixture. The apparatus of this invention is characterized by a hydraulic motor drivingly connected with the refrigerant pump, oil duct means for delivering pressurized oil from said oil pump to said hydraulic motor to energize the latter, and a housing which encloses both said refrigerant pump and said hydraulic motor.

In a preferred embodiment of the invention there are other oil duct means that communicate an exhaust oil outlet of the hydraulic motor with said discharge duct. A preferred embodiment of the invention also has sensor means for detecting a function of the capacity at which the screw compressor is operating and for producing an output which substantially corresponds to said detected function; and a controllable throttling valve in one of said oil duct means, connected with said sensor means to receive said output therefrom and whereby the flow of pressurized oil through said hydraulic motor is regulated in accordance with said output.

Further features of a preferred embodiment of the invention are described hereinafter.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT

Figure 1:
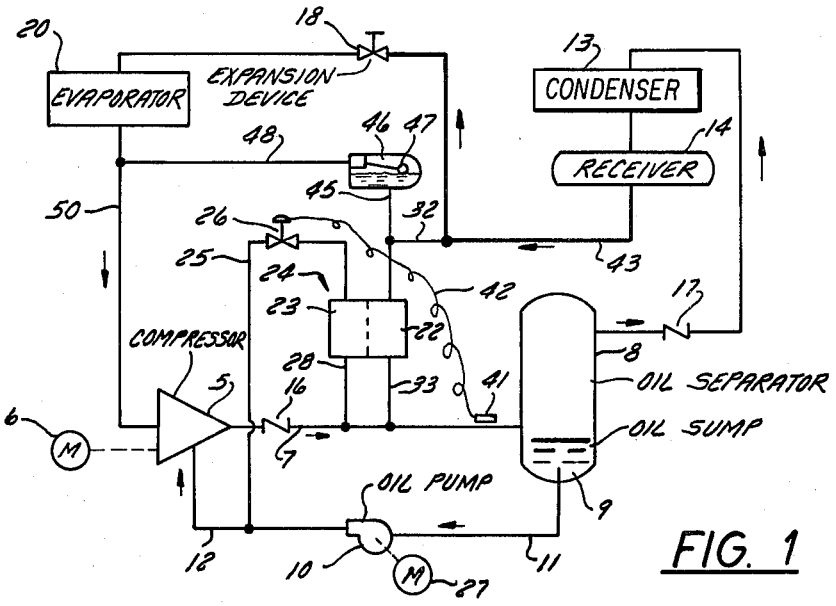
FIG. 1 is a diagrammatic representation of a refrigeration system embodying the principles of the invention.
Figure 2:
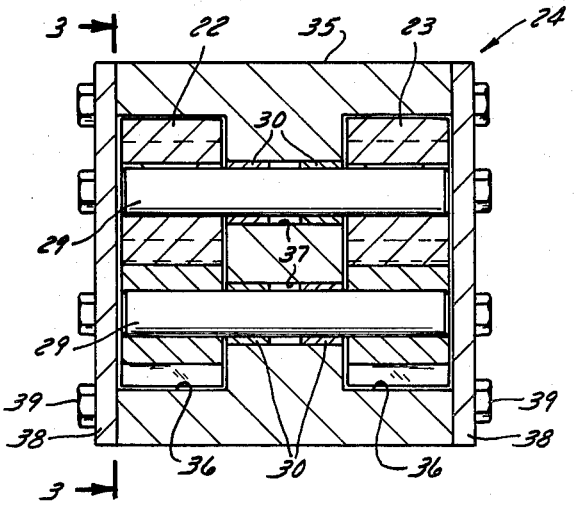
FIG. 2 is a view in longitudinal section of the unit comprising the refrigerant pump and its drive motor.

In the accompanying drawing, the numeral 5 designates a screw compressor for a high capacity refrigeration system such as is employed, for example, for air conditioning an office building. The drive motor 6 for the screw compressor 5 may be rated at several hundred horsepower. In the usual case, the screw compressor 5 can be selectively operated at its full capacity or at any desired percentage of its full capacity in accordance with cooling load requirements.

As is conventional, a substantial amount of oil must pass through the screw compressor 5 at all times that it is in operation, for lubrication, for torque transmission and for sealing the compressor to prevent escape of pressurized refrigerant from it. The oil also has the important function of cooling the compressor, which becomes heated in consequence of the work that it performs in compressing refrigerant, and therefore the oil must be cooled outside the compressor.

The oil issues from the compressor 5 in a mixture with compressed refrigerant, and this mixture is conducted, by means of a discharge duct 7, from the outlet of the compressor to an oil separator 8. In accordance with the teachings of U.S. Pat. No. 4,275,570, and as explained hereinafter, liquid refrigerant is delivered to the discharge duct 7 to cool the mixture of oil and condensed refrigerant before it enters the oil separator 8. Such cooling enables the oil separator 8 to effect a more nearly complete separation of oil from refrigerant than would occur if the mixture entered the oil separator in uncooled condition. Cooling the mixture also produces a certain amount of desuperheating of the refrigerant, in addition to accomplishing the necessary cooling of the oil.

The separated oil settles into a sump 9 in the bottom of the oil separator 8, which serves as an oil reservoir and from which the oil is drawn by an oil pump 10 that has its inlet communicated with the sump 9 by means of a recovery duct 11. Most of the oil pumped by the oil pump 10 is returned to the screw compressor 5 by way of a lubricant duct 12 and the remainder of the pressurized oil is employed as described hereinafter.

The compressed refrigerant from which the oil has been separated is conducted from the oil separator 8 to a condenser 13 at which the refrigerant is cooled to its saturation temperature to be condensed to a liquid; and from the condenser 13 the liquid refrigerant is discharged into a high pressure receiver 14, where it is held for release to the low pressure side of the system at which refrigeration takes place.

To prevent reverse flow of refrigerant when the compressor 5 is shut down or is operated at reduced output, there is a check valve 16 in the discharge duct 7 and another check valve 17 between the oil separator 8 and the condenser 13.

As is conventional, most of the liquid refrigerant is conducted from the high pressure receiver 14 through an expansion device 18 to an evaporator 20 in which the refrigerant takes up heat and vaporizes. From the evaporator 20 the warm vapor-phase refrigerant, which is at a comparatively low pressure, is conducted to the inlet of the screw compressor 5, to be compressed for a repetition of the cycle.

The liquid refrigerant that is fed into the discharge duct 7 for cooling the compressor lubricating oil and for desuperheating the compressed refrigerant is with-drawn from the receiver 14 through a narrow duct 32 and is forced into the discharge duct 7 through a delivery duct 33 by delivery means 21 comprising a refrigerant pump 22 and a hydraulic motor 23. A single sealed housing 24 encloses both the refrigerant pump 22 and its motor 23, so that together with the housing 24 they comprise a pump-motor unit.

The hydraulic motor 23 of the delivery means is energized by pressurized oil issuing from the oil pump 10. Specifically, the pressure oil inlet of the hydraulic motor 23 is communicated with the lubricant duct 12 by means of an oil inlet duct 25 which branches off from the lubricant duct 11 and in which there is a controllably variable throttling valve 26. Since the oil pump 10 serves both for energizing the refrigerant pump 22 and for return of lubricating oil to the compressor 5, it should have a somewhat higher capacity than an oil pump which serves only for returning oil to the compressor, and the motor 27 that drives it should have a correspondingly higher power rating.

The exhaust oil from the outlet of the hydraulic motor 23 passes to the compressor discharge duct 7 by way of an exhaust oil duct 28. It will be evident that oil fed into the discharge duct 7 from the exhaust oil duct 28 will pass into the oil separator 8 along with the oil-refrigerant mixture coming out of the compressor and will be separated from the refrigerant at the oil separator. It will also be apparent as the description proceeds that the controllable throttling valve 26 could be located in the exhaust oil duct 28 instead of in the oil inlet duct 25, as shown.

Figure 3:
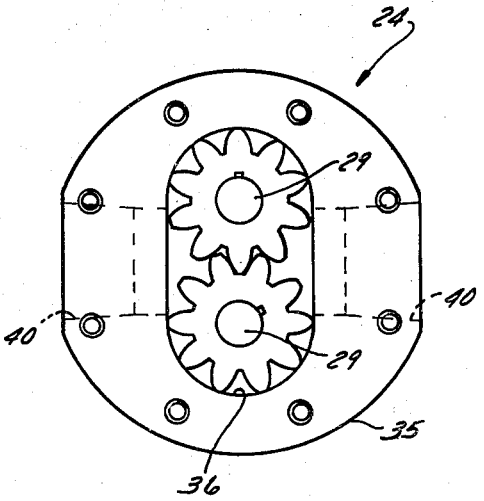
FIG. 3 is a view in transverse section of the unit shown in FIG. 2 taken on the plane of the line 3—3 in FIG. 2.

For simplicity, economy and efficiency, the refrigerant pump 22 and its hydraulic motor 23 are preferably identical in construction. Thus FIG. 3 can be regarded as showing either the refrigerant pump 22 or the hydraulic motor 23. In the present case the pump 22 and the motor 23 are illustrated as being of the gear type, but they could be, for example, of the sliding vane type.

With the motor 23 and the pump 22 identical, the driving shaft or shafts 29 of the motor can also constitute the driven shaft or shafts of the pump. In this case the bearings 30 for the shafts 29 are mounted in a medial portion of the housing 24, between the pump and the motor, and therefore the shafts do not project through any wall of that housing to require seals and pose leakage problems.

The housing 24 that encloses the refrigerant pump 22 and its motor 23 is quite simple. It comprises a central body portion 35 in which there are oppositely outwardly opening cavities 36 that form the respective chambers of the pump 22 and the motor 23. Communicating these cavities 36 with one another are bores 37 through which the shafts 29 extend and in which the bearings 30 are mounted. Opposite plate-like end walls 38 are secured to the central body portion 35, as by bolts 39, to close the cavities 36 and seal off the interior of the housing. It will be observed that no special pains need be taken to seal off the cavities 36 from one another because the oil passing through the motor 23 and the refrigerant passing through the pump 22 are both being delivered to the discharge duct 7 for immediate entry into the oil separator 8. With a gear pump and gear motor, as shown, ports 40 can be arranged symmetrically in the central body portion 35, with oil and refrigerant inlet ports at one side of the housing, near opposite ends thereof, and with outlet ports at the opposite side of the housing. So long as the two ports 40 at one side of the housing are taken as inlets, and so long as oil connections are made at one end of the housing and refrigerant connections are made at its other end, there is no need for concern about incorrect plumbing connections.

With the system of the present invention the rate of delivery of liquid refrigerant to the discharge duct 7 is controlled is a simple manner. Basically, the flow rate of liquid refrigerant to the discharge duct 7 should be matched to the capacity at which the screw compressor 5 is operating. Thus, if the screw compressor is operating at high capacity, putting a large amount of heat energy into the oil-refrigerant mixture issuing from it, the rate of delivery of liquid refrigerant to the discharge duct 7 must be higher than if the compressor is operating at low capacity. Control of the rate of flow of liquid refrigerant to the discharge duct 7 could be based on some other function of compressor output, but the objective is to maintain substantially a predetermined temperature of the mixture delivered to the oil separator—low enough for adequate oil cooling but high enough to prevent refrigerant condensation—and therefore the preferred expedient is to provide a temperature sensor 41 in the discharge duct 7, just upstream from the oil separator 8. The output of the temperature sensor 41 corresponds to the temperature of the mixture in the discharge duct 7 and is thus a function of the prevailing capacity of the compressor 5. That output is impressed upon the throttling valve 26, as by means of an electrical conductor 42, so that the throttling valve 26 opens with rising temperature in the discharge duct 7, thereby permitting a higher rate of flow of pressure oil to the hydraulic pump 23 and thus causing the refrigerant pump 22 to deliver more liquid refrigerant to the discharge duct 7.

In practice, the duct 32 through which liquid refrigerant is drawn into the refrigerant pump 22 is a small diameter duct that branches off of the duct 43 through which the main flow of refrigerant passes from the receiver 14 to the evaporator 20. According to the present invention, cavitation of the refrigerant pump 22 is prevented by means of an upright standpipe 45 that is communicated with the small diameter duct 32 just upstream from the refrigerant pump 22. At the top of the standpipe 45 is a vapor chamber 46 into which bubbles of vaporized refigerant rise along the standpipe. The vapor chamber 46 has an outlet at its top which is controlled by a float valve 47 and which is communicated by means of a vapor duct 48 with the duct 50 that conducts warm refrigerant from the evaporator 20 to the compressor inlet. When vaporized refrigerant collecting in the top of the vapor chamber 46 forces liquid refrigerant therein down below a predetermined level, the float valve 47 opens, venting the excess vapor to the lower pressure zone in the warm refrigerant duct 50. In this manner a column of liquid refrigerant is at all times maintained in the standpipe 45, under a gravity pressure head that prevents bubbles of vaporized refrigerant from passing into the refrigerant pump 22 and causing cavitation.

From the foregoing description taken with the accompanying drawing it will be apparent that this invention provides a refrigeration system of the type wherein liquid refrigerant drawn from the high pressure receiver is delivered into the mixture of oil and refrigerant passing from the screw compressor into the oil separator, having a compact, inexpensive, efficient and leak proof refrigerant pump, simple and effective means for so controlling that pump as to match its delivery of liquid refrigerant with the capacity at which the compressor is operating, and simple and effective means for preventing cavitation of the liquid refrigerant pump.

I claim:

1. Refrigeration apparatus comprising a screw compressor which is cooled and lubricated by the circulation of oil therethrough and from which a mixture of compressed refrigerant and oil issues to an oil separator through a discharge duct, oil recirculating means comprising an oil pump having an inlet communicated with the oil separator and an outlet from which pressurized oil is conducted to the screw compressor, a receiver to which refrigerant flows from the oil separator through a condenser and in which liquid refrigerant is held for circulation through an evaporator, and delivery means comprising a refrigerant pump having a refrigerant inlet connected with said receiver and an outlet communicated with said discharge duct to deliver thereto a flow of liquid refrigerant that cools said mixture, said apparatus being characterized by:

A. a hydraulic motor drivingly connected with said refrigerant pump and having an inlet for pressurized fluid and an outlet for exhaust fluid;

B. oil duct means for delivering to said inlet of the hydraulic motor a portion of the pressurized oil issuing from the outlet of the oil pump, for energizing the hydraulic motor;

C. other oil duct means communicating the exhaust outlet of the hydraulic motor with said discharge duct; and D. a housing which encloses both said refrigerant pump and said hydraulic motor.

2. Refrigeration apparatus comprising a screw compressor which is cooled and lubricated by the circulation of oil therethrough and from which a mixture of compressed refrigerant and oil issues to an oil separator through a discharge duct, oil recirculating means comprising an oil pump having an inlet communicated with the oil separator and an outlet from which pressurized oil is conducted to the screw compressor, a receiver to which refrigerant flows from the oil separator through a condenser and in which liquid refrigerant is held for circulation through an evaporator, and delivery means comprising a motor and a refrigerant pump which is driven by said motor and whereby liquid refrigerant is drawn from said receiver and delivered to said discharge duct to cool said mixture, said apparatus being characterized by:

A. said delivery means comprising (1) a sealed housing having therein (a) a pair of cavities, one near each of its opposite ends, (b) at least one bore connecting said cavities, and (c) an inlet port and an outlet port for each of said cavities, each opening from its cavity to the exterior of the housing, (2) rotary means in each of said cavities, the rotary means in one cavity comprising a hydraulic motor and the rotary means in the other cavity being of substantially the same kind but comprising said refrigerant pump, and (3) at least one shaft in said housing journaled in said at least one bore and drivingly connecting the rotary means in said one cavity with the rotary means in said other cavity;

B. oil duct means connecting said inlet port for said one cavity with said outlet of the oil pump for delivery to the hydraulic motor of a portion of the pressurized oil issuing from said outlet; and C. other oil duct means connecting said outlet port for said one cavity with said discharge duct for delivery to the latter of exhaust oil from said hydraulic motor.

3. The apparatus of claim 1, further characterized by:

E. sensor means for detecting a function of the capacity at which the screw compressor is operating and for producing an output which substantially corresponds to said detected function; and F. a controllable throttling valve in one of said oil duct means, connected with said sensor means to receive said output therefrom and whereby the flow of pressurized oil through said hydraulic motor is regulated in accordance with said output.

4. The apparatus of claim 1, wherein the refrigerant inlet of said refrigerant pump is connected with said receiver by means of an inlet duct, further characterized by:

E. an upright standpipe communicated at its bottom with said inlet duct and opening to a vapor chamber at its upper end;

F. a float valve in said vapor chamber, controlling an outlet near the top thereof and which is open when liquid in said vapor chamber is below a predetermined level; and G. duct means communicating said outlet in the vapor chamber with an inlet of the screw compressor.

* * * * *